United States Patent [19]

Kumata

[11] 4,421,422

[45] Dec. 20, 1983

[54] ELECTRONIC TIMEPIECE WITH VARIABLE MELODY ALARM FACULTIES

[75] Inventor: Kiyoshi Kumata, Tsuzuki, Japan

[73] Assignee: Sharp Kabushiki Kaisha, Osaka, Japan

[21] Appl. No.: 323,874

[22] Filed: Nov. 23, 1981

Related U.S. Application Data

[63] Continuation of Ser. No. 116,889, Jan. 30, 1980, abandoned.

[30] Foreign Application Priority Data

Jan. 31, 1979 [JP] Japan ..... 54-11157

[51] Int. Cl.[3] ..... G04B 21/00; G10F 1/00

[52] U.S. Cl. ..... 368/273; 84/1.03

[58] Field of Search ..... 368/12, 73, 75, 245, 368/250–265, 272, 273; 84/1.01, 1.03; 340/384 E

[56] References Cited

U.S. PATENT DOCUMENTS

| | | | |
|---|---|---|---|
| 3,998,045 | 12/1976 | Lester | 368/63 |
| 4,090,349 | 5/1978 | Takase | 368/73 |
| 4,163,407 | 8/1979 | Solender | 84/1.03 |
| 4,245,336 | 1/1981 | Stietenroth | 368/273 |

*Primary Examiner*—Vit W. Miska

*Attorney, Agent, or Firm*—Birch, Stewart, Kolasch & Birch

[57] ABSTRACT

A melody function in an electronic timepiece is incorporated into one or more LSI chips, which comprise a pseudo or dummy scale frequency signal generator responsive to timing signals developing from a timekeeping divider chain. In one preferred form an audible alarm sound is provided in the form of a desired melody and such melody is changeable through exchange LSI chips or changes in the contents of a random access memory.

10 Claims, 7 Drawing Figures

ELECTRONIC TIMEPIECE WITH VARIABLE MELODY ALARM FACULTIES

This application is a continuation, of copending application Ser. No. 116,889, filed on Jan. 30, 1980 abandoned.

BACKGROUND OF THE INVENTION

The present invention relates to an electronic timepiece which provides audible alarm sounds in the form of an appropriate melody.

In a conventional electronic timepiece audible alarm sounds are provided by recurrence of a signal and same frequency signal from in the middle of multiple divider stages. Such recurrence of the signal and same frequency signal causes discomfort to the user.

It is therefore an object of the present invention to provide sweet and agreeable alarms or announcements of time in the form of an appropriate melody.

A primary object of the present invention is to provide an electronic timepiece which develops alarms and announcements of time in an appropriate melody. Another object of the present invention is to provide an improved electronic timepiece which is free to change alarms or announcements of time according to the users' personal tastes.

BRIEF DESCRIPTION OF THE DRAWINGS

FIG. 6 is a block diagram of one preferred embodiment of the present invention;

FIG. 7 is a timing diagram of waveforms of various signals occurring within FIG. 6.

DETAILED DESCRIPTION OF THE INVENTION

Figure 1:
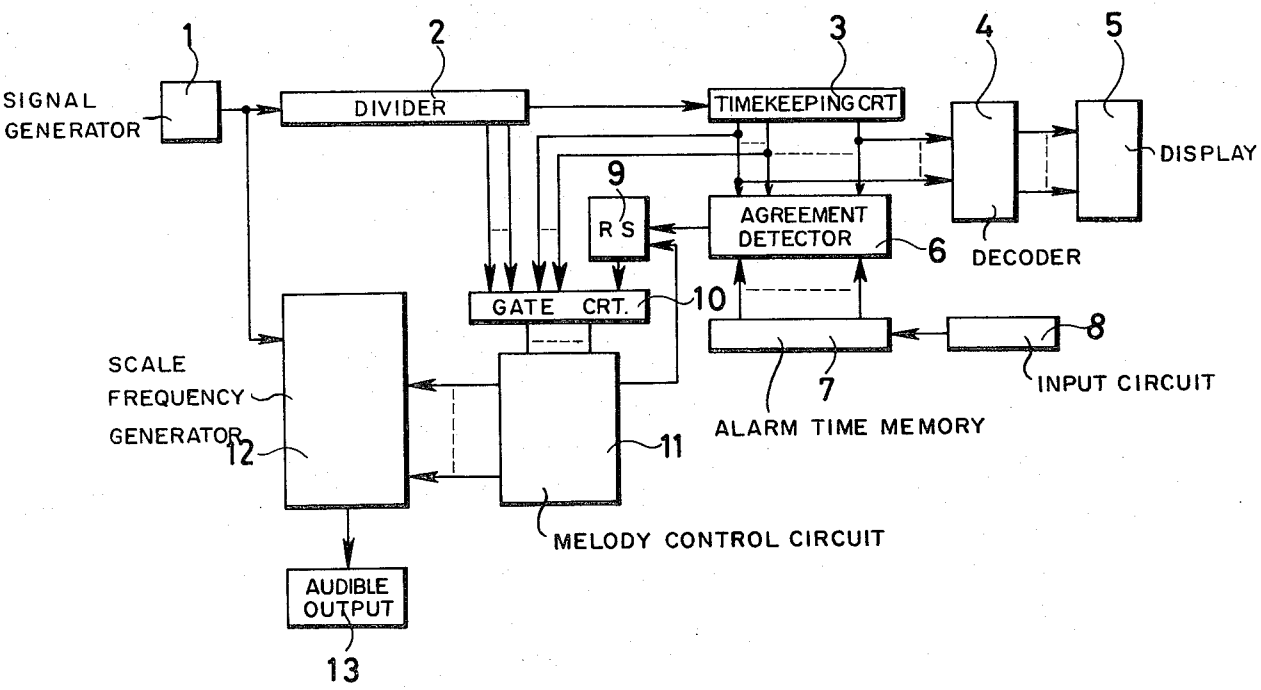
FIG. 1 is a block diagram of one preferred embodiment of the present invention.

Referring now to FIG. 1, there is illustrated one preferred embodiment of the present invention in a block diagram, which comprises a standard signal generator 1, a divider circuit 2, a timekeeping circuit 3, a decoder 4 and a display 5 in a well known manner. The standard signal generator 1 may be implemented with a conventional quartz oscillator to develop a standard signal of 32.768 kHz which in turn is subject to frequency division through the divider 2. The timekeeping circuit 3 responds to the output of the divider 2 to produce a predetermined number of pieces of time information. The respective pieces of time information are sent to the decoder 4 and visually displayed on the display 5 in a well known method.

In the illustrative embodiment, there is further provided alarm faculties which comprise an agreement detector 6 receiving the output of the timekeeping counter 3 to sense whether the time information contained within the timekeeping counter 3 agrees with preset time to be alarmed. An alarm time memory circuit 7 is adapted to store the time to be alarmed for comparison and thus receive the alarm time introduced through an input circuit 8 including externally controlled switches. Under the circumstance that the alarm time information is contained within the memory circuit 7, an RS flip flop 9 is forced into the set position upon development of the affirmative answer from the detector 6, turning a gate circuit 10 off for the purpose of developing audible alarm sounds in the form of an appropriate melody.

The gate circuit 10 receives the output from the divider 2 and the output from the timekeeping circuit 3 and supplies these outputs to a melody control circuit 11. As will be clear later, the melody control circuit 11 may be set up by, for example, a programmable ROM read only memory) from which musical scale control signals are selected in succession. A scale frequency generator 12 receives the standard signal from the standard signal generator 1 and scale control signals from the melody control circuit 11 and develops pseudo or dummy frequency signals representative of respective scales in accordance with the scale control signals. Details of how to develop the pseudo frequency signals will be discussed later. An audible output circuit 13 may include a loud speaker to develop an appropriate alarming melody in response to the output from the scale frequency generator 12.

Utilization of the standard frequency of 32.768 kHz makes it possible to produce apparently similar frequencies representative of respective scales by a combination of simple division ratios as defined Table 1. Table 1 sets forth accurate frequencies representative of the C sound through the C′ sounds within the third octave, ratios of frequency division from 32.768 kHz, frequencies indicative of respective pseudo scales and deviations from the accurate frequencies. It will be concluded from Table 1 that the pseudo scales are available within less than ±1.0% of deviation by utilization of a division ratio within a range of 15 to 31. This can be accomplished by at most two different ratios of frequency division.

TABLE 1

| | C | C#(D♭) | D | D#(E♭) | E | F | F#(G♭) | G | G#(A♭) | A | A#(H♭) | H | C′ |
|---|---|---|---|---|---|---|---|---|---|---|---|---|---|
| Accurate frequency (Hz) | 1048 | 1108 | 1176 | 1244 | 1320 | 1396 | 1480 | 1568 | 1652 | 1760 | 1856 | 1976 | 2096 |
| Division ratio from 32.768kHz | 31 | (30 + 29)/2 | 28 | (27 + 26)/2 | 25 | (23 + 24)/2 | 22 | 21 | 20 | (19 + 18)/2 | (18 + 17)/2 | (17 + 16)/2 | (16 + 15)/2 |
| Pseudo scale frequency (Hz) | 1057 | 1110.8 | 1170.3 | 1236.5 | 1310.7 | 1394 | 1489.5 | 1560.4 | 1638.4 | 1771.2 | 1872.5 | 1985.9 | 2114 |
| Devision from accurate frequency (%) | +0.86 | +0.25 | −0.48 | −0.6 | −0.7 | −0.14 | +0.64 | −0.48 | −0.82 | +0.64 | +0.89 | +0.5 | +0.86 |

Details of scale frequency generator 12 are disclosed and illustrated in my copending application Ser. No. 2,218, Jan. 9, 1979, AN ELECTRONIC TIMEPIECE WITH MELODY ALARM FACULTIES (Ref. 1202) and FIGS. 6 and 7 of the present invention FIG. 6 illustrates details of the scale frequency generator 12. Apart from the timekeeping divider 2 there is further provided a divider 14 which comprises four state flip flops responsive to the standard signal G from the standard signal generator 1. The Q outputs of the respective states are sent to a division ratio control 15. The division radio control 15 may be implemented with a ROM matrix which comprises a large number of N channel MOS transistors. The division ratio control 15 is programmed to produce logic "0" level outputs at the respective output lines thereof when the logic conditions of the standard signal G and the outputs of the respective state $Q_1$, $Q_2$, $Q_3$ and $Q_4$ meet "01111", "10000", . . . "11111". It will be noted that these logic conditions correspond to respectives ones of division ratios from 15 ("01111") up to 31 ("11111"). A logic "0" level signal is sequentially developed at the respective output lines each time the counting operation of the divider 14 starting with the initial condition thereof ("00000") reaches the end of the first half of corresponding unit cycles each decided by the respective division ratios.

AND logic gates $A_{15}$–$A_{31}$ contained within a division ratio selection control 16 receive the reversed outputs of the respective output lines of the ROM matrix as one inputs and the scale control signals C, C#, D, . . . H, C' as other inputs and calls the output signals from the ROM matrix according to the scale control signals. The outputs thus called are led to a reset pulse generator 17 which is adapted to reset the divider 14 at every occurrence of a reset signal R and thus each time the first half of the unit cycle corresponding to the selected one of the division ratio has passed. In conclusion, these serve as a variable divider of which the division ratio is equal to one half the one selected by the AND logic gates $A_{15}$–$A_{31}$ of the division ratios listed in Table 1. The reset pulse R is the output of this variable divider. In other words, the reset pulse R serves to derive a frequency signal twice as the frequency corresponding to the division ratio on Table 1 from the standard signal G.

At T flip flop 18 serves as a shaping circuit 18 to divide the reset pulse R from the reset pulse generator 17 by two and form a ½ duty pulse, developing the pseudo frequency signals M corresponding to the respective scales on Table 1.

By way of example, the pseudo scale frequency signal M of 1170.3 Hz substantially indicative of the D sound (1176 Hz) will be developed in the following manner. It is clear from Table 1 that the division ratio effective to obtain the pseudo D sound scale from 32.768 kHz is 28. The AND logic gate $A_{28}$ is turned on upon receipt of the scale control signal D so that only the outputs from the corresponding output line of the ROM matrix is supplied to the reset pulse generator 17, resetting the divider 14 at every 14th cycle (28/2=14) of the standard signal G. This event is depicted in a timing diagram of FIG. 7. The reset pulse R is supplied to the shaping flip flop 18, carrying out 2/1 frequency division to form the ½ duty pulse. The result is the frequency signal M of 1170.3 Hz which is 1/28 divided from the standard signal G.

It is obvious from Table 1 that the respective scales of the C#, D#, F, A#, H, C' sounds, etc., are apparently obtainable through a combination of two division ratios. The T' flip flop 19 of FIG. 6 responsive to the reset pulse R is provided for controlling the division ratios. The corresponding two of the AND logic gates $A_{15}$–$A_{31}$ are switched on alternatively with respect to each other through the AND gates $A_{15}'$–$A_{19}'$, $A_{23}'$, $A_{24}'$, $A_{26}'$, $A_{27}'$, $A_{29}'$, $A_{30}'$, ($A_{23}'$, $A_{24}'$, $A_{26}'$, $A_{27}'$ are not illustrated).

In the case of the C# sound, the scale control signal C# is applied to the AND logic gates $A_{30}'$, $A_{29}'$, selecting alternaively the AND logic gates $A_{30}$, $A_{29}$, selecting alternatively the AND logic gates $A_{30}$, $A_{29}$ according to the respective output Q and $\overline{Q}$ from the division ratio controlling flip flop 19 which is inverted each time the reset pulse R is generated. As a result, the divider 14 effects 1/15 division and 1/14.5 division repeatedly and alternatively.

OR logic gates $O_1$–$O_3$ are provided for taking account of the fact that adjacent two scales are dependent upon the same division ratio, for example, the A and A# sounds in combination and the H and C' sounds in combination. The output logic for the AND logic gates $A_{15}'$–$A_{19}'$ is tabulated as follows:

TABLE 2

| AND logic gate | output logic |
|---|---|
| $A'_{15}$ | $\overline{Q} \cdot C'$ |
| $A'_{16}$ | $Q \cdot (C' + H)$ |
| $A'_{17}$ | $\overline{Q} \cdot (H + A\#)$ |
| $A'_{18}$ | $Q \cdot (A\# + A)$ |
| $A'_{19}$ | $\overline{Q} \cdot A$ |

Assume that the scale control signal A# corresponding to the A# sound is applied. The AND logic gates $A_{17}'$ and $A_{18}'$ are to be placed into the on condition through the OR gates $O_2$ and $O_3$. As stated above, the AND logic gates $A_{17}$ and $A_{18}$ are alternatively selected in response to the outputs Q and $\overline{Q}$ from the division ratio controlling flip flop 19.

In the case where the pseudo scale is established by a combination of two division ratios, the pseudo scale frequency signal M available from the shaping flip flop 18 is not accurately the pulse waveform of a ½ duty factor. This error corresponds to the half cycle of the standard signal G and is negligible. The division ratio controlling flip flop 19 may be responsive the the frequency signal M to reverse in state in order to produce the pseudo scale frequency signals as defined in Table 1 on the average.

Figure 2:
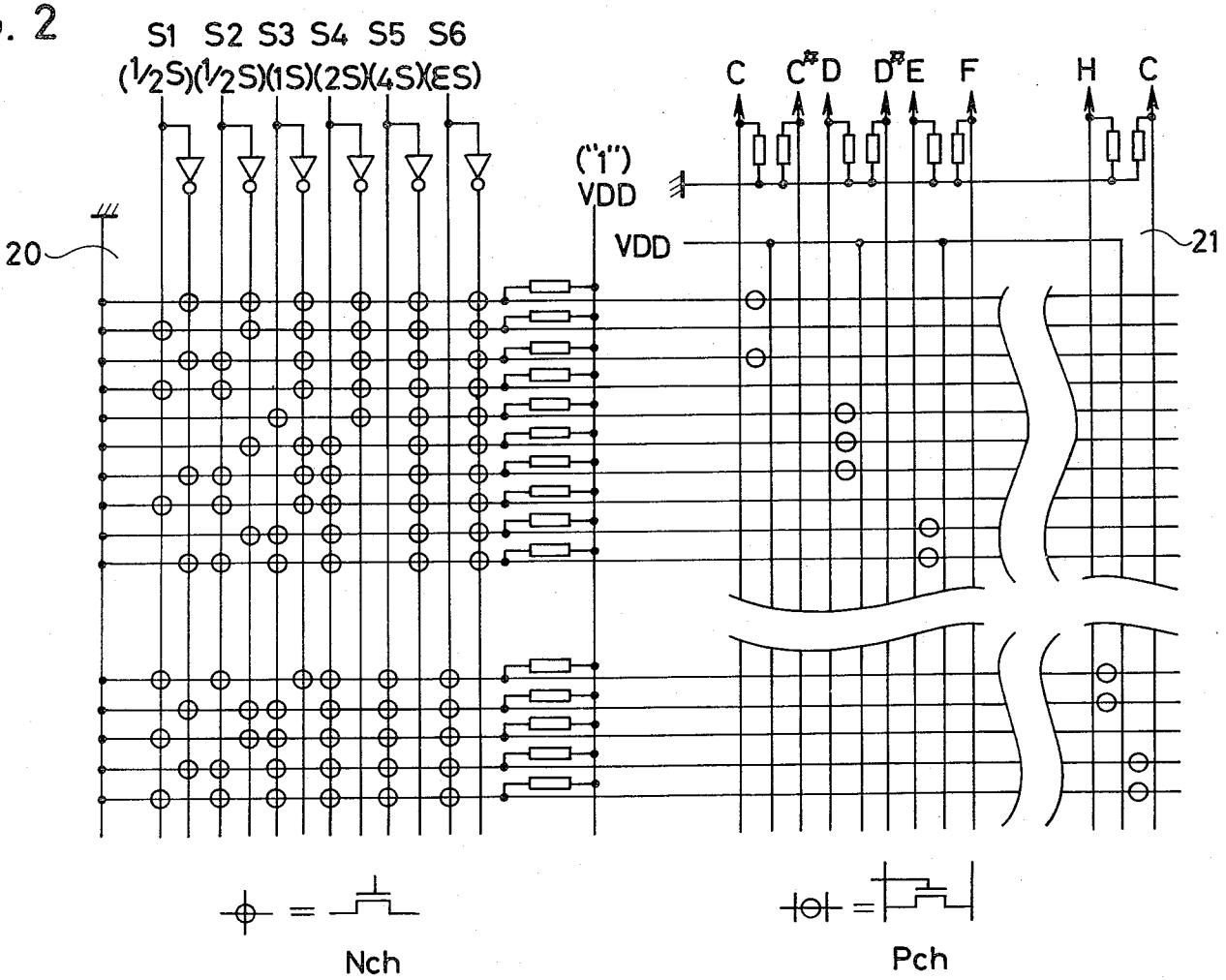
FIG. 2 is a block diagram showing details of a principal portion of the embodiment of FIG. 1.

FIG. 2 is a detailed circuit diagram of the melody control circuit 11. The melody control circuit 11 consists of a timing decoder section 20 and a scale control signal generator section 21, the former containing an N channel MOS transistor ROM matrix and the latter containing a P-channel MOS transistor ROM matrix. Signals $S_1$–$S_6$ applied to the timing decoder section 20 correspond to the divider outputs and the timekeeping outputs of FIG. 1. That is, the decoder section 20 receives the 4 Hz (¼ sec) signal $S_1$, the 2 Hz (½ sec) signal $S_2$, and the 1 Hz (1 sec) signals $S_3$ as the divider outputs and the 2-sec signal $S_4$, the 4-sec signal $S_5$ and the 8-sec signal $S_6$ as the timekeeping outputs. The timing decoder section may be programmed at an interval of at least ⅛ sec and for a period of 8 sec.

Figure 4:
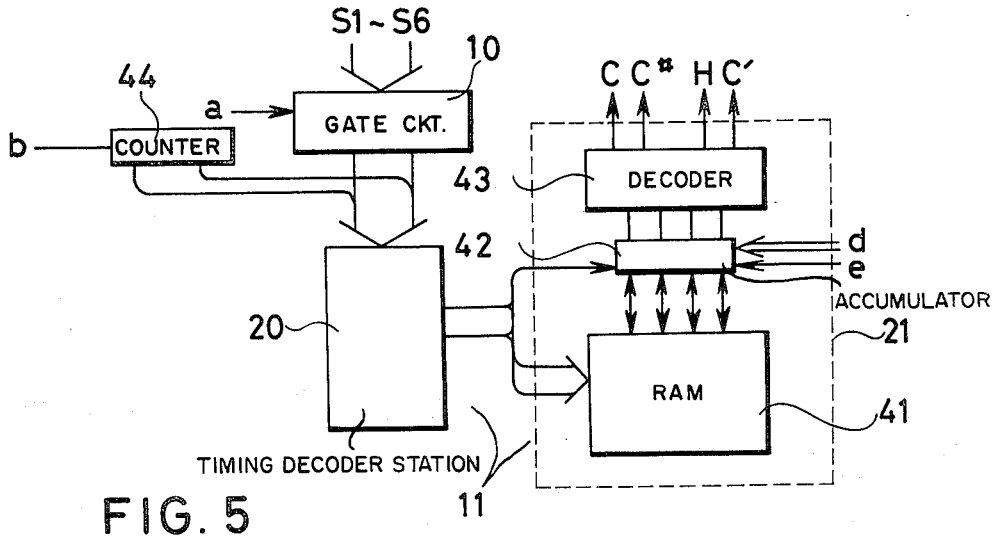
FIG. 4 is a block diagram showing details of another basic portion of the embodiment of FIG. 1.
Figure 5:
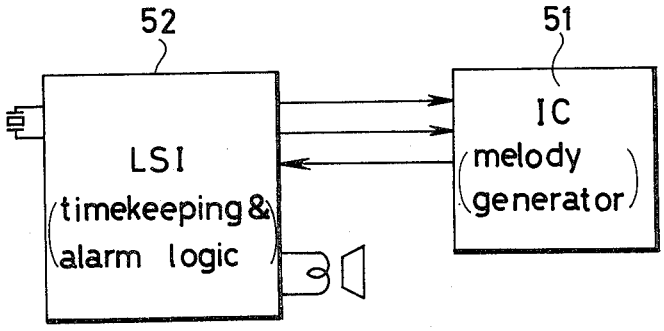
FIG. 5 is a block diagram of still another preferred embodiment of the present invention.

Reverting to FIG. 1, when the timekeeping contents of the time-keeping counter 3 agree with the alarm time contained within the alarm time memory circuit 6, the agreement decision circuit 6 is activated so urge the RS flip flop into the set position, permitting the divider output and the timekeeping outputs to enter into the melody control circuit 11 via the gate circuit 10. If the divider outputs and the timekeeping outputs and in other words $S_1$–$S_6$ of FIG. 4 are all at a logic "0" level, (for example, all at a "0" level when such agreement covers more than units of minutes), the respective output lines of the ROM matrix within the timing decoder section 20 provide the "0" level output in sequence pursuant to the stored program with the elapse of time. At the same time the ROM matrix within the scale control signal generator section 21 selects the musical scale and develops the scale control signals C, C#, D, . . . H, C' for the scale generator circuit 12.

Under the assumption that the quarter note is one second long, the shortest step of $\frac{1}{8}$ seconds is equal to length of the thirty-second note, making it possible to program all scale equal to or longer than the thirty-second note. However, in the case where the same scale is developed in succession, it is necessary to insert a definite distinction between the respective ones of the notes and insert a pause equal to the time duration of the thirty-second note at last. It is preferable to program musical notes in terms of a total length of the indivisual notes. In this instance, musical notes equal to or longer than the sixteenth note are programmable and for example the sixteenth note in the form of a thirty-second note+a thirty-second note and the eighth note in the form of a thirty-second×3+a thirty-second.

Melodies can be automatically completed by, for example, resetting the R-S type flip flop 9 by virtue of the output derived from the timing decoder section at the final step. Otherwise, the R-S type flip flop 9 may be reset by actuation of an external switch.

Control for the second duration is mask-programmable in either the ROM matrix of the timing decoder section 20 or the counterpart of the scale control signal generator section 21. Provided that the respective output lines of the timing decoder section 20 provide the "0" level outputs each time $\frac{1}{8}$ seconds have passed, the sound durations of the respective output lines of the scale control signal generator section 21 each supplying the individual scale control signals except for the last pause period corresponding to the duration of the thirty-second note. In design of the duration program any desired steps can be omitted from the timing decoder section 20.

Figure 3:
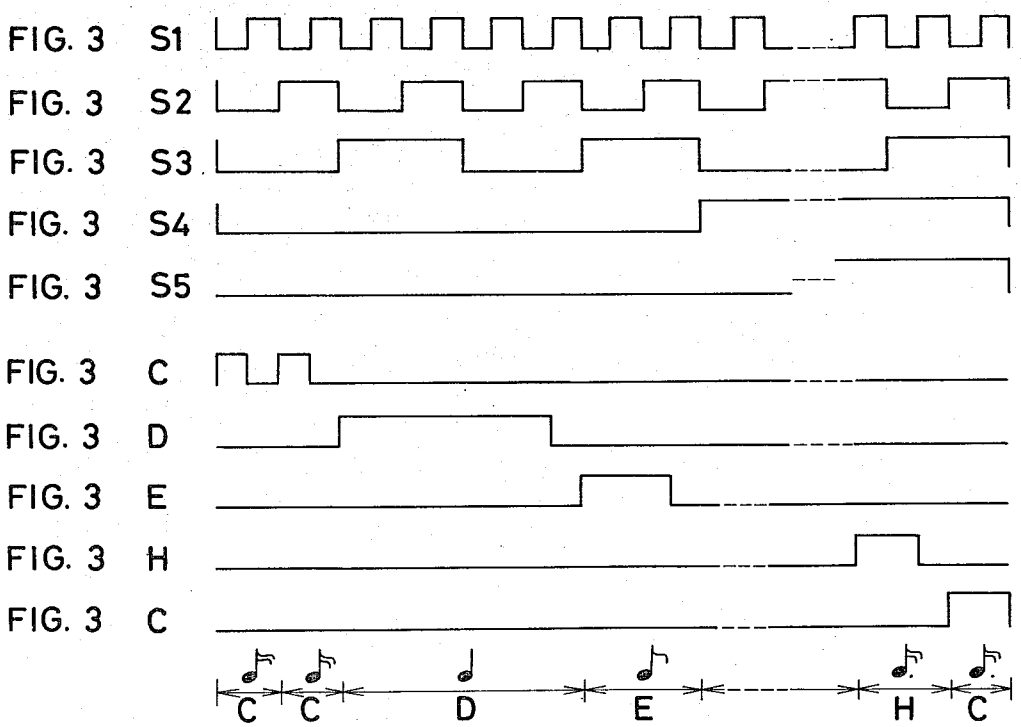
FIG. 3 is a timing diagram of waveforms of various signals occurring within FIG. 1.

FIG. 3 illustrates various events during the procedure where the scale control signals are developed in the circuit of FIG. 2. In the given example, the quarter note ♩ is represented in terms of one second. Although the scale control signal C concerning the C sound actually lasts for $\frac{1}{8}$ seconds corresponding to the thirty-second note, a thirty-second rest note is added just after the control signal C to provide a definite break in the successive generation of sounds with the total duration being equal to that of a sixteenth note. This is true to the other scale control signals D, E, H, C, etc. In order to develop the scale control signal D concerning the D sound for the period corresponding to the quarter note, a logic condition (001xx) is incorporated into the timing decoder section 20 corresponding to the initial program location of the scale control signal generator section 21. Four steps (00100), (00101), (00110) and (00111) are derived from a signal output line. Another logic condition (0100x) is also incorporated into the next succeeding program location, permitting two steps (01000) and (01001) to be derived from a common output line. This allows eliminating of some steps. This is equally applicable to an eighth note of the E sound. Such elimination of the step number is effective to simplification of circuit construction of the timing decoder section 20 and the scale control signal generator section 21. In this manner, the melody control circuit 11 may be programmed to meet the user's taste at the user's option through the utilization of the ROM matrix. The contents of the stored program are alterable by using an erasible mask programmable ROM (EPROM) matrix or an electrically erasible programmable ROM (EEPROM) matrix. Accordingly, the present timepiece can always provide fresh and unique melodies.

FIG. 4 is a block diagram showing another preferred embodiment of the present invention, wherein the scale control signal generator section 21 is complemented with a random access memory (RAM) within the memory control section 11 thereby making a melody pattern easily and freely alterable. More particularly, the scale control signal generator section 21 includes the above mentioned RAM 41, an accumulator 42 and a decoder 43 and preferably an additional counter 44.

When alarm time is reached, the RS type flip flop 9 (FIG. 1) is set to turn on the gate circuit 10 so that the frequency division outputs and timekeeping output signals $S_1$–$S_6$ are supplied to and decoded by the timing decoder section 20. The output of the decoder is supplied as an address selection signal to the RAM 41 and as a transfer control signal to the accumulator 42 so that the contents of the RAM 41 are sequentially read and supplied to the decoder 43 via the accumulator 42. The decoder 43 decodes them into the respective ones of the scale control signals.

If it is desired to alter the melody, an additional counter 44 is incremented whenever a switch signal b is applied. The output of the counter is supplied to the timing decoder section 20 to sequentially address respective operating steps. A switch signal d allows a specific signal corresponding to the scale control signal to enter the accumulator 42 and another switch signal e as a transfer control signal allows the same to enter the RAM for storage. Any desirable melody can be easily written or learned through repetitive application of the switch signals b, d and e.

It is obvious that the present invention is applicable to any circuit implementation by one or more ICs. Generally speaking, a single-chip IC is more preferable from the viewpoints of structure and productivity. It is of course possible that an IC for the melody generator section 51 may be separate and removable from an IC constituting the timekeeping and alarm logic section 52 for the purpose of providing a plurality of agreeable melodies. It is concluded that a significant advantage of the present invention is easy selection of melodies.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. An electronic timepiece comprising:

alarm time sensing means for generating an alarm signal at a preselected time of day;

tune storage means for storing information indicative of the frequency and duration of each of a desired series of musical notes, said tune storage means providing a series of note frequency and duration signals in response to the generation of an alarm signal by said alarm time sensing means;

input means for altering the information stored in said tune storage means in response to an operator initiated input;

a frequency generator for generating a high frequency time standard signal;

divider means for producing a multiplicity of frequency from said high frequency time standard signal;

means for selecting a desired frequency produced by said divider means corresponding to each desired musical note and responsive to its associated note frequency and duration signal produced by said tune storage means;

means for enabling said means for selecting for a time duration for each desired note responsive to its associated note frequency and duration signal; and an audio generator for generating an audible musical note upon application of each desired frequency generated by said divider means for a time duration determined by said means for enabling;

wherein time storage means includes:

an M×N line matrix array means, said M lines corresponding in number and interconnected with the outputs of said divider means, said N lines corresponding in number to the number of note frequency and duration signals to be produced and thus to the notes of a desired molody to be generated, said M×N line matrix array means decoding said digital timing count into sequentially produced duration signals generated on said N lines and corresponding to the duration of said notes: and K×L line matrix array means, said L line corresponding in number and interconnected with said N lines of said M×N line matrix array, said K lines corresponding to individual scale notes, said K×L line matrix array means coding note frequency information into said duration signals to form the note frequency and duration signals;

said M×N line matrix array means decoding more than one count of said digital timing count into a single duration signal on a signal N matrix line.

2. An electronic timepiece comprising:

alarm sensing means for generating an alarm signal at a preselected time of day;

tune storage means for storing information indicative of a desired series of musical notes and their durations, said tune storage means providing a series of note frequency and duration signals in response to the generation of an alarm signal by said alarm sensing means;

a frequency generator for generating a high frequency time standard signal;

a signal frequency divider connected to said frequency generator and having a plurality of selected division ratios;

means for selecting the desired division ratio from said plurality of selectable division ratios to constrain said divider to produce a desired frequency corresponding to each desired musical note in response to its associated note frequency and duration signal produced by said tune storage means;

means for enabling said means for selecting for a time duration for each desired note responsive to its associated note frequency and duration signal; and an audio generator for generating an audible musical note upon application of each desired frequency from said divider for a time duration determined by said means for enabling, said audio generator producing a musical tune by the successive generation of said desired series of musical notes.

3. An electronic timepiece alarm for an electronic timepiece including a frequency generator which produces a high frequency time standard signal, said alarm comprising:

alarm time sensing means for generating an alarm signal at a selected time of day;

tune storage means for storing information indicative of a desired series of musical notes and their durations, said tune storage means providing a series of note frequency and duration signals in response to the generation of an alarm signal by said alarm time sensing means;

a single frequency divider connected to said frequency generator and having a plurality of selectable division ratios;

means for selecting the desired division ratio from said plurality of selectable division ratios to constrain said divider to produce a desired frequency corresponding to each desired musical note and responsive to its associated note frequency and duration signal produced by said tune storage means;

means for enabling said means for selecting for a time duration for each desired note responsive to its associated note duration signal; and an audio generator for generating an audible musical note upon application of each desired frequency from said divider for a time duration determined by said means for enabling, said audio generator producing a musical tune by the successive generation of said desired series of musical notes.

4. The electronic timepiece alarm of claim 2 or 3, wherein said single frequency divider includes a fixed division ratio divider including at least N stages, each of said stages having an output, said divider having a reset terminal; and wherein said means for selecting includes:

an M row×N column transistor array, the N columns of said array being driven by said divider stage outputs, the M rows of said array being connected through a note enabling circuit ot the reset terminal of a count corresponding to the division ratio necessary to produce said desired frequency corresponding to that row; and note selection means responsive to said musical note signals and controlling said note enabling circuit for enabling at least one row of said array to thereby select said desired frequency.

5. The alarm of claim 4 wherein said alarm time sensing means comprises:

alarm time storage means for storing a signal indicative of a desired alarm time;

means for providing a signal indicative of the actual time of day; and means for comparing the signal indicative of said desired alarm time with the signal indicative of the actual time of day and producing an alarm signal upon coincidence thereof.

6. The timepiece of claim 2 or 3 wherein said high frequency time standard signal of said frequency generator is applied to said single frequency divider.

7. The timepiece of claims 2 or 3 wherein time storage means includes:

an M×N line matrix array means, said M lines corresponding in number and interconnected with the outputs of said frequency divider, said N lines corresponding in number to the number of note frequency and duration signals to be produced and thus to the note of a desired melody to be generated, said M×N line matrix array means decoding said digital timing count into sequentially produced duration signals generated on said N lines and corresponding to the duration of said notes; and K×L line matrix array means, said L lines corresponding in number and interconnected with said N lines of said M×N line matrix array, said K lines corresponding to individual scale notes, said K×L line matrix array means coding note frequency information into said duration signals to form the note frequency and duration signals;

said M×N line matrix array means decoding more than one count of said digital timing count into a single duration signal on a single N matrix line.

8. The electronic timepiece according to claim 2, wherein said tune storage means is implemented with a read only memory (ROM).

9. The electronic timepiece according to claim 2 wherein said tune storage means is implemented with a random access memory (RAM) having external write and erase means.

10. The electronic timepiece according to claim 2, wherein said tune storage means is implemented with a first integrated circuit separate and removable from a second integrated circuit including the remaining portions of said electronic timepiece.

* * * * *